United States Patent [19]

Burger

[11] 4,244,710

[45] Jan. 13, 1981

[54] AIR PURIFICATION ELECTROSTATIC CHARCOAL FILTER AND METHOD

[76] Inventor: Manfred R. Burger, Wolfratshauser Strasse 45j, 8023 Pullach, Fed. Rep. of Germany

[21] Appl. No.: 904,305

[22] Filed: May 9, 1978

[30] Foreign Application Priority Data

May 12, 1977 [DE] Fed. Rep. of Germany ..... 2721528
Jan. 24, 1978 [DE] Fed. Rep. of Germany ..... 2802965

[51] Int. Cl.[3] ..... B03C 3/00

[52] U.S. Cl. ..... 55/6; 55/126; 55/131; 55/151; 55/152; 55/138; 55/154; 55/DIG. 36; 55/279; 55/387; 422/4; 422/5; 422/121

[58] Field of Search ..... 55/2, 6, 124–126, 55/128–132, 136–138, 151–155, 385 G, 387, 279, DIG. 36; 126/299 F; 422/4, 5, 121

[56] References Cited

U.S. PATENT DOCUMENTS

| | | | |
|---|---|---|---|
| 636,304 | 11/1899 | Vosmaer | 55/152 |
| 2,579,441 | 12/1951 | Palmer | 55/138 |
| 2,579,445 | 12/1951 | Wauburton | 55/131 |
| 2,974,747 | 3/1961 | Coolidge, Jr. et al. | 55/124 |

FOREIGN PATENT DOCUMENTS

| | | | |
|---|---|---|---|
| 2000768 | 1/1970 | Fed. Rep. of Germany | 55/124 |
| 2506520 | 8/1976 | Fed. Rep. of Germany | 55/279 |
| 1029116 | 5/1953 | France | 55/151 |
| 39-13477 | 9/1964 | Japan | 55/124 |
| 41-30400 | 3/1966 | Japan | 55/124 |
| 45-6121 | 2/1970 | Japan | 55/387 |

*Primary Examiner*—Bernard Nozick
*Attorney, Agent, or Firm*—Stevens, Davis, Miller & Mosher

[57] ABSTRACT

An air purification filter is provided which has a housing; an inlet in the housing for air to be purified; a microporous filter medium, activated charcoal, which is placed in the housing so that the air to be purified passes through this microporous filter medium. The microporous filter medium serves as an electrostatic filter, with the air, including the particulate matter in the air, being charged to one polarity just prior to reaching the microporous filter medium, and with the microporous filter medium itself being directly charged, with an electrode at the downstream surface of the microporous filter medium. In a preferred embodiment an odor neutralizing medium bearing a charge opposite to that of the microporous filter medium is placed upstream of the microporous filter medium.

25 Claims, 9 Drawing Figures

1
2
3
+
−
4
5

Fig.2a
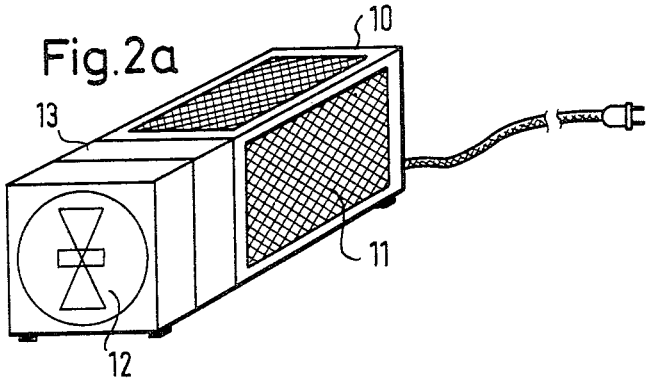
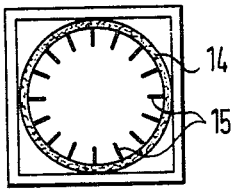
Fig.2b
Fig.3
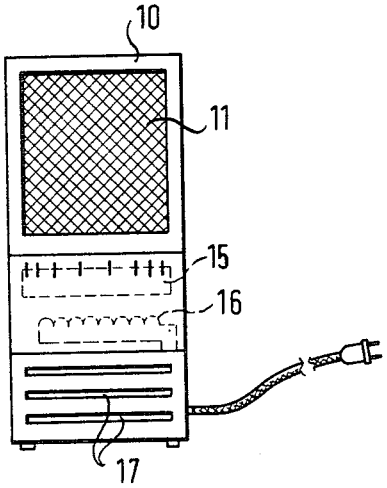
Fig.4
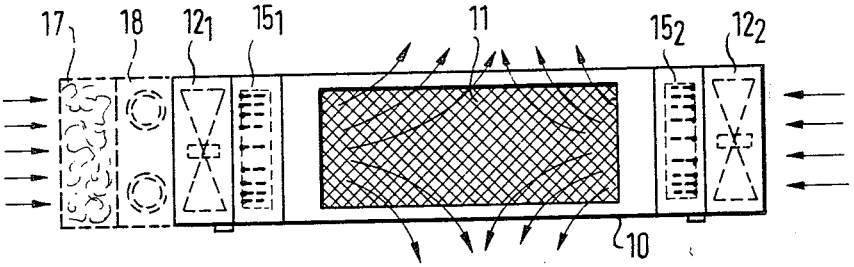

AIR PURIFICATION ELECTROSTATIC CHARCOAL FILTER AND METHOD

SUMMARY OF THE INVENTION

The present invention provides a method for the purification of gases, finding particular applicability in the removal of smoke and kitchen odors in closed systems, such as restaurants, kitchens and the living areas of residences and offices. As opposed to traditional electrostatic plate or grid filters requiring frequent exchange of filter media and problems in reducing odors particularly after prolonged use, the present invention provides an air purification filter comprising: a housing; an inlet in the housing for air to be purified; a microporous filter medium in the housing so that the air to be purified passes therethrough; an outlet in the housing for the purified air; means for directly electrically charging said microporous filter medium to one polarity; and means for electrically charging the air to be purified to an opposite polarity upstream of the filter medium so that they carry that charge when entering the filter medium, whereby when the charged particles enter the filter medium they are attached to the oppositely charged filter medium and held thereby and separated from the air.

The microporous filter medium should have the ability to be charged, and in a preferred embodiment is activated charcoal. It will be appreciated that ceramic and plastic foam materials also have such attributes. For example, a metallized plastic foam may be used. The means for directly electrically charging the microporous filter medium provide an electric field in the microporous medium itself, with which to attract the oppositely charged particles. Thus, the microporous filter medium is an electrostatic filter. This is distinguished from the prior art downstream use of activated charcoal as a supplement to an electrostatic plate or grid filter, where the primary electrostatic filtering takes place through the electrostatic grid. Additionally, the charge is placed directly on the microporous filter medium, as opposed to being transferred from the housing of the microporous filter medium. The charge is advantageously placed on the downstream side of the microporous filter medium, to provide the optimal distribution of the charge throughout the microporous filter medium.

The means for electrically charging the particles preferably is an electrode having sharp or pointed edges which facilitates the ionization of the air. A plurality of needles arranged in a plane perpendicular to the air flow is one embodiment of this invention. A wire may also be stretched in the direction of the air flow, or the edge of a blade may be used. In a further embodiment of the invention an odor neutralizing substance, which may be a scentstone (Duftstein), a gel or a liquid, may be placed upstream from the microporous filter medium and carry the opposite charge of the microporous filter medium. Such odor neutralizing substance may be selected dependent upon the type of air which is being purified. For example, where the air includes a particular noxious chemical substance which in the past has been known to be attracted to a particular type of odor neutralizing substance, such substance may be incorporated as the odor neutralizing substance of this aspect of the invention. With the enhanced effect of the charged odor neutralizing substance, it will be seen that the incorporation of the odor neutralizing substance may be used to effectively combat particularly troublesome odors included in the air stream.

In a still further aspect of the present invention an independent electrostatic filter plate having a charge opposite to that of the microporous filter medium may be placed in the air stream. This also serves to facilitate ionization of the gas.

The present invention also includes the method of removing particulate matter from the air through passing particulate laden air charged to one polarity through a microporous filter medium which has been directly charged to the opposite polarity, preferably through the use of the apparatus of the present invention.

The amount of current which is used should be sufficient to provide adequate charging of the air and the filter medium to cause an attraction between the oppositely charged particles and filter. A direct current of preferably from about 6 to about 15 kV and at least 1 watt, and preferably 2 to 50 watts, is used. The gas flow proceeds at a speed of from about 0.05 to about 0.5 meters per second, and preferably from about 0.1 to about 0.25 meters per second.

It will be appreciated that a fan included in the system to more rapidly force the air through the system may be of particular advantage.

BRIEF DESCRIPTION OF THE DRAWINGS

The invention is illustrated by the drawings wherein:

FIG. 2*a* shows an overall view of an air purification system;

FIG. 2*b* is a cross-section of FIG. 2*a;*

FIG. 3 shows an air filter including a low capacity heater which generates the air flow through the filter;

FIG. 4 illustrates a higher capacity air purification filter;

DETAILED DESCRIPTION OF THE INVENTION

Figure 1:
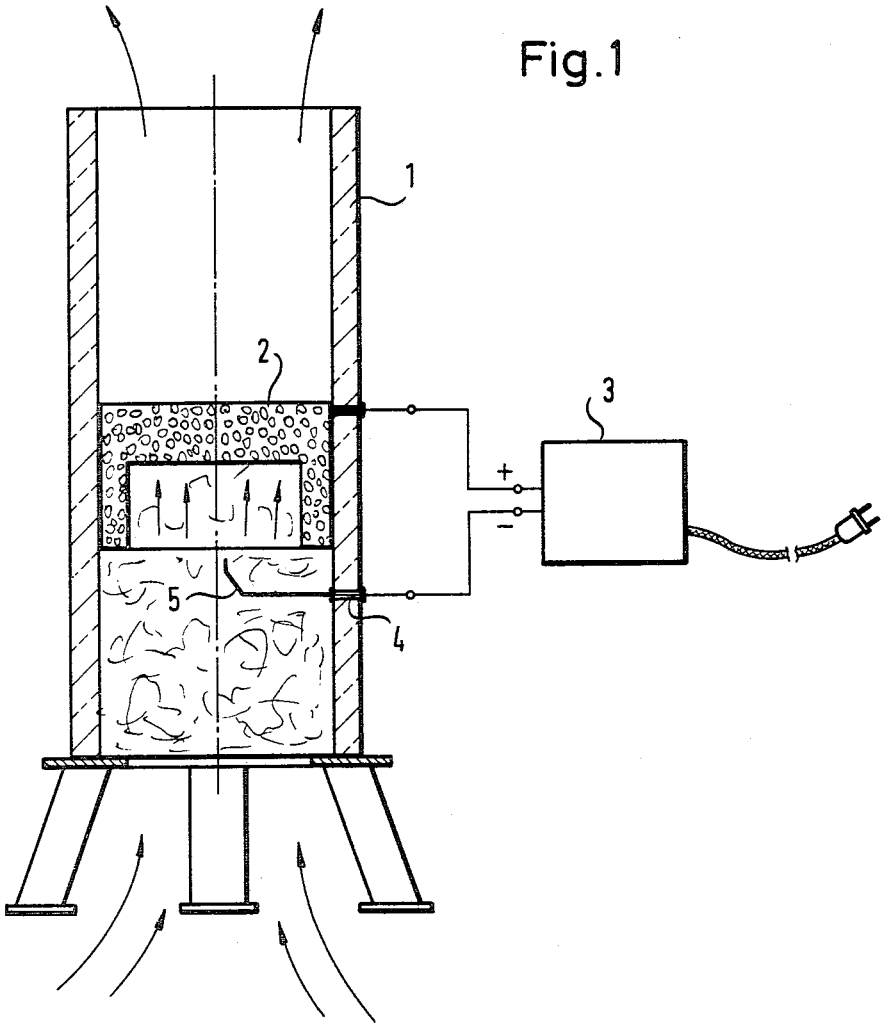
FIG. 1 illustrates an experimental model which has been used to test the efficiency of the system.

It will be appreciated that through the present invention a relatively small filter system may be used which, due to the incorporation of a microporous filter medium such as activated charcoal, has a superior effect to filter systems having many times the volume of the filter of the present invention. Thus, by using activated charcoal as a material in place of a grid of metal plates, for example, it may be seen that with the vast surface area of a microporous filter medium, it is possible to far more efficiently remove a high percentage of particles from an air stream than with the traditional electrostatic grid filter. It is important for the efficient operation of the filter of the present invention that the microporous filter material itself be directly charged, as opposed to merely placing the microporous filter medium into a charged housing. The charge is preferably placed on the microporous filter medium itself on the downstream side of the microporous filter medium so that it is away from the direction of the approaching gas current having the opposite potential, thereby insuring that all internal surface areas of the activated charcoal participate as an electrostatic filter, as opposed to merely a mechanical filter.

The means for electrically charging the particles in the air to be purified in its generic aspect may include such conventional charging means as a wire. It has been discovered, however, that it is preferable to have one or more sharp needles or a sharp cutting edge placed in the path of the gas stream. In tests with the air purification filter of the present invention it has been found that the effectiveness of removing polluted gases such as room air having cigarette smoke is improved greatly through the use of the present invention as opposed to a conventional electrostatic filter having the traditional plates. This improvement results from the combination of the microporous filter medium with the extremely large surface area taken together with the electrostatic filtering based upon what is traditionally a mechanical filter, i.e., the microporous filter medium of activated charcoal.

One of the advantages of a microporous filter medium is that various types of microporous filter media have specific effects on specified types of gases. For example, activated charcoal absorbs carbon monoxide while having little effect on other toxic substances such as found in cigarette and tobacco smoke or food odors in restaurants. According to a preferred embodiment of the present invention, activated charcoal is used as the filter medium, together with an odor neutralizing substance placed upstream of the activated charcoal which is selected based upon the type of impurity in the air which is better attached by such a odor neutralizing substance as opposed to activated charcoal. For example, a scentstone (Duftstein) attracts certain types of odors, such as etheric oils that may be found in kitchen odors. The scentstone is placed upstream of the filter medium, but in the area where the air has been charged to a potential opposite to that of the filter medium. The scentstone is advantageously charged with a like potential to that of the filter medium. Scentstones are in porous form and are obtainable as well as high density solids. The scentstone used in the invention is an antiodorous substance known per se, and may be a combination consisting of an aromatic principle or fragrance or a composition made from such odoriferous substances and a carrier substance known per se, which may be fugitive, such as a liquid, or solid hydrocarbon or an aqueous medium thickened with an organic or inorganic thickener, such as a colloidal carboxy vinyl polymer. Preferably the perfume composition provides a fresh smelling odor, such as of an apple, orange, lemon or rose. This gives the treated air a fresh odor and binds and absorbs the bad smell of the air to be purified.

Figure 6:
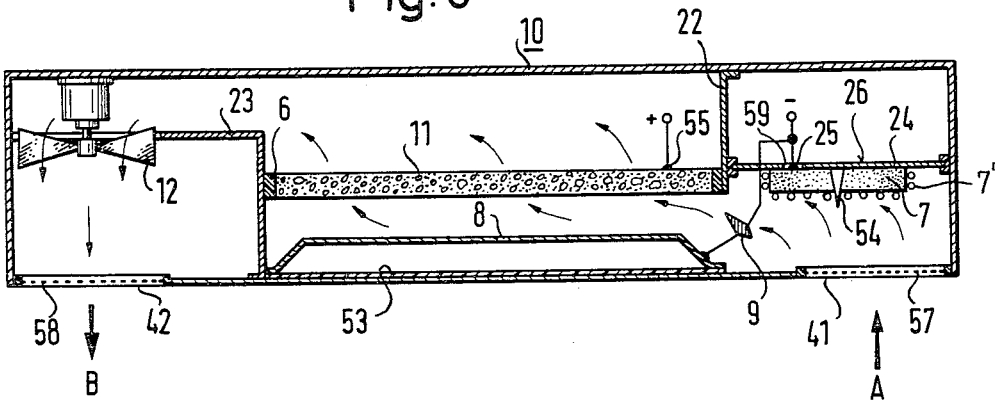
FIG. 6 illustrates a wall mounted air purification filter.

For several tests, a scentstone was used according to the apparatus of FIG. 6, the scentstone being of the type L.V. 2037 "green apple" was used on a high capillary cellulose carrier supplied by Globus Werke, Fritz Schulz, D-8858 Neuburg/Donau, Germany and having the dimensions $11\times5.5\times0.4$ cm. A similar type of antiodorous substance is offered by Waldwick Plastic, Inc., 21-23 Industrial Park, Waldwick, New Jersey 06701, U.S.A.

Experimental tests further showed in a restaurant ambiency that even with use of the scentstone for six weeks in an electrostatic field, no appreciable decrease of the odor-binding ability of the scentstone in combination with the filter was observed.

The external shape of a scentstone may be adapted to the dimensions of the filter in order to assure the optimum contact of as many gas particles as possible with the scentstone. A porous scentstone may advantageously be used and adapted to the cross-sectional dimension of the gas path so that very large internal surface of the scentstone come into contact with the gas. The scentstone having the opposite potential to that of the filter medium, it acts to ionize the gas passing through or along it. The charge is advantageously applied to the odor neutralizing substance such as the scentstone downstream from the gas flow so that the scentstone acts as a pole with a relatively large surface.

It may also be advantageous to impale the scentstone onto a thorn passing slightly through it, or a sharp edge which simultaneously serves to hold the scentstone. In this case ionization of the passing gas occurs mainly at the protruding edge or point; the scentstone is now only a secondary point of origin for the lines of the field and will be used rapidly which may be advantageous if continuous purification with strongly smelling etheric oils in the air is not a necessary or desirable feature.

The odor neutralizing substance may also be in a liquid or gel form. When in a liquid form, there is advantageously provided a passage through which the gas must pass through the liquid, and with the liquid being given a charge opposite to that of the filter medium.

Experiments with odor neutralizing substances in their solid form have been conducted to test the purification of office rooms that are filled with tobacco smoke. Using a scentstone, a good filtration action has been observed after relatively long use concerning numerous pollutants, although a relatively shorter duration is noted for kitchen exhaust systems for normal kitchen odors. Through the aspect of the invention providing both the use of a microporous filter and an odor neutralizing substance with the opposite potential of the filter medium, excellent results have been obtained. It will be observed that a particular advantage of the present invention is that with the combination of the odor neutralizing substance and the microporous filter medium that after a considerably long period of operation the system works well, as opposed to systems of the prior art where relatively good results may be obtained initially but after continued operation of the system the results fall off markedly.

The degree of efficiency of the air purification filter of the invention may vary somewhat depending upon such factors as the cross-sectional area of the filter, the speed of the gas current, the particle size of the impurities, and their weight, and the composition of the microporous filter material. The degree of ionization of the gas prior to entry into the microporous filter medium is considered to be of major importance. Tests have shown that the distance between the electrodes, that is the distance between the microporous filter medium and the means for electrically charging the particles in the air has only a relatively minor effect on the efficiency of the filter. Rather, raising the applied tension to raise the degree of ionization leads to an improved effectiveness of the filter. Improvement is also achieved when a plurality of poles are used as the means for electrically charging particles. It is also important that the electrode which forms the means for electrically charging particles has the highest possible ionization effect which is achieved by field concentration, therefore concentration is given in the first instance to razor blade-like cutting edge electrodes or needle or brush electrodes.

In some European countries it is believed that through ionization of the air (such as the liberation of positive ions from television sets) that it may be beneficial to reduce such a positive ion concentration. It is also believed in some European countries that an excess of positive ions also may lead to an increase in dust development in the rooms. The air purification filter of the present invention may, therefore, be used to coincidentally counteract such a build-up of positive ions liberated from television sets by attaching the free sharp edge or pointed pole forming the means for electrically charging particles of the air purification filter to the negative clamp of the high tension generator while the positive terminal is connected to the surface of the microporous filter medium. If the scentstone is used, it should be connected on the side opposite to the direction of the gas current to the negative terminal of the high tension generator. If the scentstone, however, is equipped on one side with a needle sharp or sharp edged metallic ionization element, it may be advantageous to attach the opposite pole to the scentstone on a side opposite to the microporous filter medium so that the scentstone again can act as a large surface source pole. The air purification filter of the present invention thereby has a net effect of liberating negative ions. From the standpoint of removing particulate matter from the air, it is not critical whether the microporous filter medium is positive or negative (provided the particles are oppositely charged), with the above choice of polarities being given only from the standpoint of the preference noted in certain European countries for decreasing the number of positive ions in the air. Where this is not a factor, it will be appreciated that either positive or negative polarity may be given to the microporous filter medium.

The theory of positive ions in the air is explained in German Patent No. 1,261,295 at page 22. In addition, to demonstrate the lack of criticality in the polarity of the microporous filter medium charge and also to make it possible to adjust the degree of ionization of the room air, the air purification filter may be provided with means to make it possible to switch the polarity. Thus, a reversing switch may be provided which can be equipped with a time device so that the field may be reversed from time to time. If it is desired to minimize ionization of the air from the air purification filter, it is possible to insert an ion absorber, such as a metal grid, into the housing downstream of the microporous filter medium. Although activated charcoal is predominately mentioned as an example of the microporous filter medium, it should be recognized that other microporous filter media may also be used. Such other microporous filter media may be used provided that they contain a layer on the microporous internal surface which is at least electrically semi-conductive so that the electrostatic field is fully effective. Ceramic filters, mircoporous resin filters, silica gels, and other materials which have been made conductive to at least a certain extent may be used in place of the activated charcoal. It will also be appreciated that the air purification filter may be used in conjunction with other devices, such as the inclusion of an ultraviolet radiation device to help kill germs in the air. It should also be recognized that while primary emphasis has been given in this specification to the cleaning of room air with smoking odors or kitchen odors, the type of air which may be purified is not so limited. The air purification of the present invention may be used in offices, residences, laboratories, conference rooms and also in hospitals. For example, in hospitals, the activated charcoal filter medium may be used either alone as a part of the present air purification filter, or together with the treatment of the same air with ultraviolet light to aid in the killing of germs. In restaurants and homes it is important to purify kitchen exhaust vapors, which it having been found that an odor neutralizing substance may advantageously be used as a part of the air purification filter. Automotive systems also may be considered, both in terms of purification of the air in the interior of the car which is recirculated, and also in areas of heavy city traffic where it may be desirable to purify the "fresh" air which includes the city odors—smoke stacks, exhausts from other automobiles, etc. Larger units may be used for air purification in traffic intensive areas where there is limited air circulation, particularly crowded intersections in downtown centers and tunnels. Factory workshops are another area where the air purification filter of the present invention may be used, such as electric welding areas. The efficacy of the air purification filter is demonstrated using the experimental arrangement of FIG. 1. Into a plastic tube 1 with an internal diameter of about 10 cm there was introduced an activated charcoal filter 2 to block the current of gas which flows upward in the tube 1. Filter 2 was attached to the positive pole of a high tension generator 3 which has a power of less than 10 watts and yields a direct current tension of 5–15 kV. In principal, any method could be used which is suitable for the generation of high tension direct current of a relatively low power such as a high tension transformer of line voltage with subsequent ratification, voltage double cascade switching with diode elements and intermediate storage and condensers. The negative pole of the high tension current and generator 3 was attached by way of conduit 4 in cylinder 1 to needle electrode 5 and the point of which is placed about into the middle of the activated charcoal tablet which is used as the filter medium 2. The position of the point relative to the cross-section of the filter is of relatively minor importance, it being more important that the charge is placed on the downstream side of the filter medium 2. The axial distance between the filter 2 and the electrode 5 is also of relatively minor importance. It is, rather, important that the point of the electrode 5 is the point closest to the filter medium 2 for the electrostatic field developed between electrode 5 and filter 2.

The purification effect was determined primarily by use of air strongly laden with cigarette tobacco smoke. In an embodiment not shown in FIG. 1, a second activated charcoal filter tablet was placed in the cylinder 1, while maintaining constant voltage and the number of electrodes 5. However, the utilization of the current caused by the ionization yielded a filter effect with a single charcoal table that was effective in removing over 90% of the particles, so that it was found unnecessary as a practical matter to have more than the one activated charcoal tablet.

An improvement of the filter effect was achieved by substituting for the needle electrode 5 a sharp edged blade, in the test a razor blade being used as the sharp edged blade. As in the case of a needle electrode, the results with a blade electrode provide a high concentration of the electric field at the point or the edge with a strong ionization effect. A further improvement is achieved by raising the degree of ionization through raising the field intensity of the electrostatic field by raising the potential different between the electrode 5 and the filter 2. This also applies with raising the number of electrodes 5 with constant voltage.

Changing the polarization at the high tension generators so that electrode 5 is positive and filter medium 2 is negative yielded no noticeable change in results, demonstrating that the selection of polarity is unimportant, provided that the filter medium 2 and the electrode 5 are oppositely charged.

FIG. 2*a* shows an air purification filter for room air purification. A housing 10 having a closed backside contains an exchangeable microporous filter medium 11, which preferably is activated charcoal in the form of a cylinder which is charged with a positive or negative potential using a high tension generator which is contained in the device. In the front of the housing 10 a fan 12 is arranged which, where needed, forces air through the filter housing. Between the fan 12 and the microporous filter medium 11 there is found a structure 13 which ionizes the gas passing through the housing. This construction is shown in more detail in FIG. 2*b* which shows an isolated ring 14 to which there is attached a multiplicity of needle electrodes pointing inwardly and which may suitably be bent in the direction of the current. These electrodes are connected to the alternate pole of the high tension generator. As the gas moved by fan 12 flows along the electrode 15 the gas is ionized and then passes into the electrostatically active microporous filter medium, here made of activated charcoal 11. The arrangement of the ionization electrode 15 can, of course, be structurally different. Thus, although a ring with needle-like projections is illustrated, one may provide a star-shaped arrangement of blades which are attached to a coaxial center instead of the internal chamber of the filter cylinder in which arrangement an equal distance to the internal surface of the filter is preferably maintained on all sides. It is also possible to use wires although the ionization effect of wires is not as good as that achieved with sharped edged blades or needle electrodes.

The device according to FIG. 3 corresponds to the structure of FIG. 2*a* with the distinction that the fan 12 is exchanged for a heating device 16. The heat drives the air upwardly through the housing 10, the thus heated air being passed through the electrodes 15 and thus being ionized. The air is drawn into the system through the air admission slits 17, and after having been heated by the heating device 16 and ionized by the electrodes 15 it then passes through the filter medium 11 housed in the upper part of the housing 10.

FIG. 4 is a higher capacity device in which polluted air is sucked into housing 10 by use of blowers 12/1 and 12/2 arranged at opposite sidewalls of the housing. The air then flows along an arrangement of ionization electrodes 15/1, 15/2, and the thus ionized particles then pass through the microporous filter medium 11, preferably of activated charcoal. It is recognized that there may be situations where air is particularly dirty and many of the particles would be screened through more traditional air filtration systems. For example, many of the particles in particularly dirty air could be prescreened through a mechanical filter 17 and/or an ultraviolet light filter 18 may be placed upstream of the air particularly for killing germs. It will be appreciated that the filter of FIG. 4 may be used without the mechanical pre-filter 17 or the UV light filter 18, or together with either one or both of these. The combination of these additional elements may be particularly useful in industrial air cleaning and in laboratories. In the case of the arrangement of FIG. 4 for industrial scale operations, an even higher degree of purification is achieved if the needle ring electrodes are replaced by blade or comb electrodes arranged in star form inside cylindrical filter element 11. Optimal air passage and current value of about 0.25 meters per second with profusion from all sides may be used for hospital operating rooms. This also may be used for residential areas, such as living rooms. The desired air passage and current value of 0.25 meters per second may be achieved through exit of the purified air over a large area from microporous filter medium 11 as illustrated in FIGS. 2—4.

Figure 5:
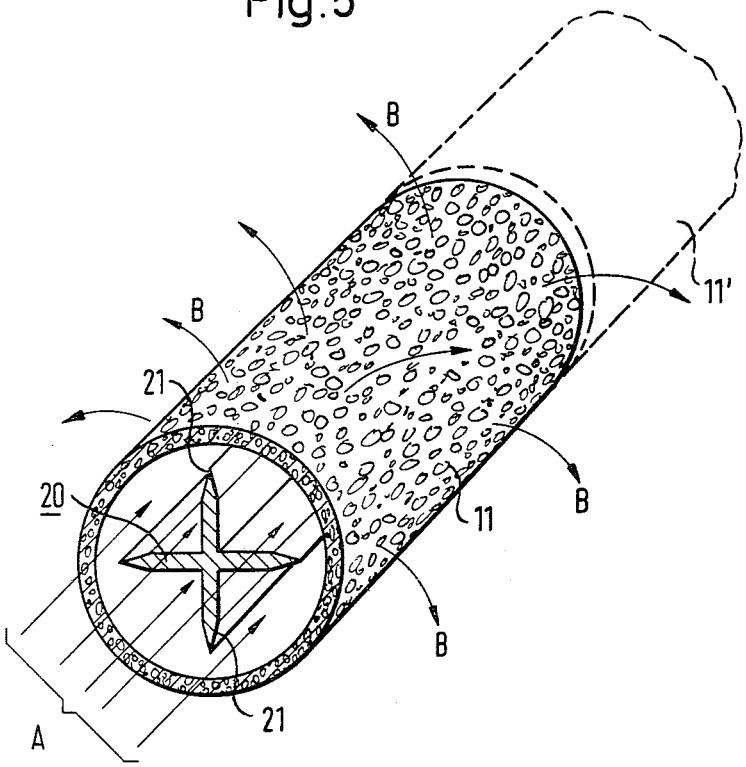
FIG. 5 illustrates an air purification filter utilizing a cylindrical microporous medium.

In FIG. 5 an air purification filter in accordance with the present invention is shown with a hollow cylinder of activated charcoal used as the filter medium 11 and equipped with electrode 20 which is formed on the inside as a cutting blade electrode running in axial direction with four blades 21 arranged in starshape. The sharp free edges of blade 21 all have the same radial distance from the internal surface of microporous filter medium 11 along the axial length of the filter. The gas supply, for example, results by means of a fan (not shown) and runs in the direction of the arrows shown in FIG. 5. Along the sharp edges of blades 21 the gas is ionized and then runs through filter medium 11 which has a high counter potential to the potential of electrode 20.

It will be recognized that if a higher capacity is desired the activated air purification filter may comprise a plurality of microporous filter elements 11, such as the utilization of two or more activated charcoal cylindrical filters. Ionization can also be improved by increasing the number of blades from four to eight to the star-shaped electrodes 21. Instead of blades 21 there may also be used comb-like elements. Microporous filter medium 11 is preferably closed at the end by a lid (not shown) in order to cause optimal radial distribution of the gas in a low exit rate from the filter with a high gas through-put.

FIG. 6 is a schematic diagram for an air purification device which has been tested for office rooms and restaurants. It contains essentially a rectangular or oval filter housing 10 with an opening for admission of air 41 and an exit 42 which are equipped with protective gratings 57 and 58 respectively. Ventilator 12 is driven by an electric motor which pulls the air in direction A over the entrance opening 41 and causes the purified air which is passed through microporous filter medium 11 through the exit 42 in direction B. The path of the current of air in housing 10 is directed by walls 22, 23 as well as conducting sheet 8, the function of which is described in more detail hereinafter. In the path of the stream through the filter housing the air to be purified first meets scentstone 7 which is affixed to plate 24, which plate is isolated from housing 10 and equipped with a central thorn 54. Thorn 54 can stick out to a minor extent above the scentstone into the surface of the passing air. On the side 26 opposite the plane along which the air passes, the isolated plate 24 can show a break 59 at which scentstone 7 has immediate electric contact at 25 and is connected with a negative pole (not shown) high tension direct current source in the above mentioned manner which may for example be housed in filter housing 10. The scentstone 7 suitably in conjunction with a thorn 54 and beyond it, acts as a source pole of an electrostatic field the counter pole of which ends in microporous filter medium 11 in a manner described in more detail below. At passing air along scentstone 7 the latter is partially ionized already, and the results are an enhanced elimination of polluted air particles by means of the scentstone the use of a liquid as an odor neutralizing substance.

In the further path of the stream the air then meets at first the so-called external ionization 9 which consists of one or more wires or of a brush from metal electrode or, for example, a sharp edged metal piece in the form of a star or diamond. Important for the external ionization 9 are sharp or pointed edges at which there occurs high field concentration and correspondingly there results a good ionization of the gas stream thereby. Of course, it is to be recognized that the external ionization suggested in outline form in FIG. 1 is maintained isolated in filter housing 10 and also connected with a negative pole of the high tension source in the equipment.

Further downstream the air meets conducting plate 8, which can, for example, be glued to an isolated base 53 in housing 10. The coducting plate 8 is also connected with a negative pole of the high tension source; on one hand it serves for uniform distribution of the gas stream over the area of microporous filter medium 11 and on the other hand it acts as an additional ionization and also furnishes additional ionization of the gas stream.

Filter medium 11 which can be exchanged through an opening at the housing between conducting separating walls 22 and 23 (not shown) is in the example here illustrated made of activated charcoal. At the external bottom layer 6 is impenetratable for gas. Housing 10 is impenetratable for the gas. The active charcoal tablet forming the microporous filter medium 11 is connected at least at point 55 directly with positive pole (+) with the high tension source (not illustrated) at the side turned away from conducting sheet 8 in the direction of the path of the gas.

The high tension source furnishes a potential of, for example, 10 kV with a power of about 5 to about 10 watts by attaching the high tension potential to the downstream surface of the microporous filter medium which achieves the result that essentially the entire large inner surface of the activated charcoal tablet acts as a positive pole of the electrostatic field.

The entire apparatus can be constructed on a relatively small scale. In order to obtain a sufficient separation of the air coming in an unpurified form in the direction A from the purified air flowing away in the direction B one can place a separating sheet approximately in the middle of the housing. It is also possible to turn the air admission opening 41 by about 90° against the exit opening 42, thus, for example placing it into the side surface of housing 10. Microporous filter medium 11 can be easily exchanged as can the scentstone 7. However, even with continuous use, as for example in the case of a restaurant, this exchange does not need to occur for some time, several months at least being possible for operation of the system without the necessity of changing either the filter medium 11 or the scentstone.

Figure 7:
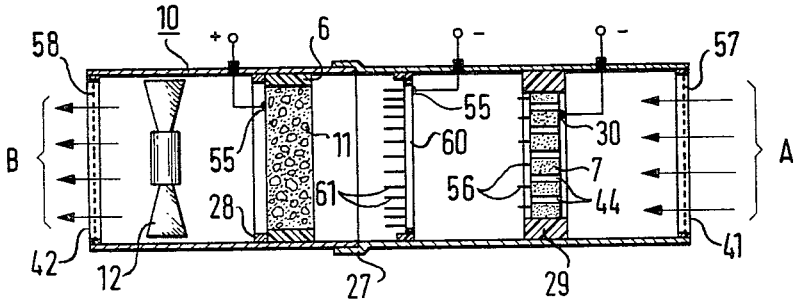
FIG. 7 illustrates a kitchen air purification filter.

In accordance with FIG. 7, the filter housing 10 has the shape of a cylinder and at 27 shows a sub-division so that the microporous filter medium 11 is readily exchanged. Here, the microporous filter medium 11 is an activated charcoal tablet. The positive flow of the high tension source (not shown) is again attached at 55 to the microporous filter medium at the gas exist face opposite the plane of the gaseous stream. The external border 6 of the microporous filter medium 11 again prevents an exit of the gas in the original direction and serves simultaneously for high tension insulation of the microporous filter medium 11 against housing 10 as well as against ring 28 by which microporous filter medium 11 is secured in housing 10 against axial displacement.

In the course of the gas stream from A to B prior to passage through the microporous filter medium 2 the gas passes scentstone 7 which is mounted exchangeably in mount 29. This scentstone 7 shows a multiplicity of channels 44 for air passage running in an axial direction, while on the side opposite to the direction of the gas current A there protrudes small metallic points or edges 56. In this case, scentstone 7 is attached electrically to the negative pole of the high tension source at the side of the gas stream at 30. The additional external ionization 9 is placed between the scentstone 7 and the microporous filter medium 11; in this case it is a ring 60 isolated from housing 10 and equipped with a multiplicity of needle points 61 protruding into the stream. Equally effecitvely one may use a sharp edge or jagged tooth formation of elements by which effective ionization of the gas in the path between scentstone 7 and microporous filter medium 11 is assured. The external ionization 9 is again connected to the negative pole of the high tension source by a ring 60.

The filter arrangement according to FIG. 7 is especially suitable for purification of kitchen exhaust gases because the air to be purified is exposed shortly after admission into entrance opening 41 to very intensive contact with scentstone 7 which has a negative high tension potential. Ventilator 12 again serves as a vacuum ventilator; equally well, one could use a pressure fan on the side of the admission of the air.

Figure 8:
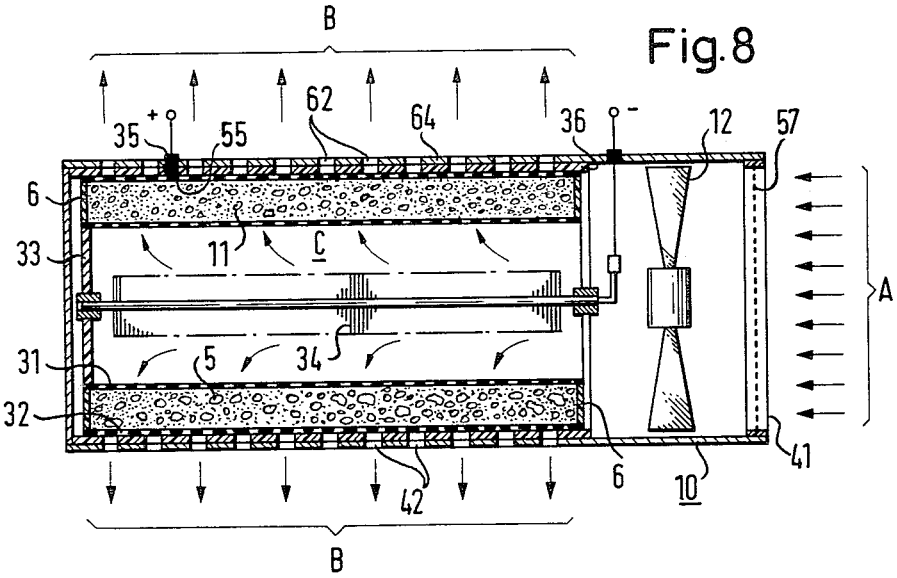
FIG. 8 illustrates a cylindrical activated charcoal filter.

In the case of the filter device according to the invention as illustrated in FIG. 8, one uses as the exchangeable microporous filter medium 11 a cylinder of activated charcoal. As the filter housing 10 is in a cylindrical form but shows in the area of microporous filter medium 11 a multiplicity of air openings 62 and can thus consist of a shaped material 64. For protection against, for example, children reaching into the apparatus a grating may be provided as grate protection 57, provided at the side of the entrance of the air. As microporous filter medium 11 activated charcoal is used which is filled into the space between the two sheet metal cases 31 and 32 arranged coaxial towards one another. The front end of the cylindrically formed microporous filter medium 11 is again covered with a gas impenetrable layer 6. On the area opposite to the gas current A the cylindrically formed microporous filter medium 11 is closed by lid 33.

The air is sucked in the direction A by ventilator 12 and pressed in axial direction into internal space 7 of the cylindrically formed microporous filter medium 11; thus it passes ionization device 34, which is in the form of a metallic wire round brush and is ionized at the numerous wire points sticking out in all radial directions. The round brush-type ionization device shows a length which, for example, corresponds to the axial length of microporous filter medium 11 and is connected to the negative pole of a high tension source (not shown) which is maintained isolated on the inside of the cylindrically formed microporous filter medium co-axially on this same axis.

By the change of direction in the inside of the cylindrically formed microporous filter medium 11 there results at the numerous points of the brush-like edges 34 a high degree of ionization. The air thus ionized enters through numerous openings into the inner cage of the filter and into charcoal and thus comes into intimate contact with the large surface of the counter pole of the activated charcoal. The positive potential charging the active charcoal derived from the high tension source is again applied immediately by way of an isolated lead 35 at 55 at a place away from the air current.

In order to be able to exchange the microporous filter medium 11 readily and to provide resistance against the high tension that serves within filter housing 10 a resinous can 36 with numerous perforations may be used which permits good gas passage in radial direction. It is important that the application of the positive potential to the microporous filter medium 11 does not occur through the outer perforated cage 32 but rather immediately to the activated charcoal material because otherwise the field lines between the negatively charged ionization device 34 and the positive counter pole do not end in the charcoal material but mainly in the metallic cage.

It will be understood that the above-described embodiment may also be combined with an odor neutralizing substance, preferably subjected to a negative potential in accordance with the manner previously discussed.

The capacity of the high tension source is suitably related to the capacity and the place of use of the filter. With smaller to medium size devices one uses direct high voltage of about 6 to about 20 kilovolts, preferably up to 15 kilovolts, with power of about 0.5 to about 50 watts preferably up to 30 watts. With high capacity devices such as for the exhaust of large commercial kitchens such as in restaurants, there may be suitable for filter media with large diameters potential differentials of up to 30 kV with ionization of up to several hundred milowatts.

The foregoing description serves to illustrate the invention, the metes and bounds of the invention being defined by the appended claims.

What is claimed is:

1. A method for purifying air comprising:

passing air containing particles between an inlet and outlet of a housing;

filtering said air through a charcoal microporous filter medium placed in the path of particles contained in said air, said charcoal microporous filter medium having a surface communicating with the inlet for receiving air containing particles and a surface communicating with the outlet for delivering air to said outlet;

applying an electrical charge of a first polarity by an electrical connection to said surface of the charcoal filter medium communicating with the outlet for delivering air making electrical contact with said charcoal filter medium, whereby an electrostatic pole is primarily contained in the large interior surface of said charcoal filter medium; and charging particles in the air to be purified to a second polarity opposite the first polarity of said charcoal filter medium before the particles reach the surface of said charcoal filter medium communicating with said inlet whereby said charged particles entering said charcoal medium are electrostatically attracted to said charcoal filter medium and held thereby separated from the air.

2. A method of claim 1, wherein said microporous filter medium is activated charcoal.

3. A method of claim 2, wherein the electrostatic field has at least one watt power.

4. A method of claim 3, wherein a direct current of 6 to 15 kV and 2 to 50 watt is used.

5. A method of claim 1, wherein the velocity of the air flow is from about 0.05 to 0.5 meter per second.

6. A method of claim 5, wherein said velocity is from 0.1 to 0.25 meter per second.

7. A method of claim 1, wherein an odor neutralizing substance is placed in the path of the air to be purified between said microporous filter medium and said inlet, said odor neutralizing substance carrying a like charge as said particulate-laden air.

8. A method of claim 7, wherein said odor neutralizing substance is a scentstone.

9. A method of claim 7, wherein said odor neutralizing substant is a gel or liquid.

10. An air purification filter comprising:

a housing having an inlet and outlet forming a conduit for a stream of air containing removable particles;

a porous charcoal filter located within said housing between said inlet and outlet and electrically isolated therefrom for filtering substantially all of the air passing between said inlet and outlet, said charcoal filter having a first surface communicating with said inlet and a second surface communicating with said outlet;

a first electrostatic pole located within said housing and spaced apart from said charcoal filter towards said inlet for charging the particles in the air entering said inlet to a first polarity before said particles reach said charcoal filter; and means for directly applying a voltage between said electrostatic pole and the surface of said charcoal filter which communicates with said outlet through an electrical connection in contact with said surface of the charcoal filter without substantially reducing the flow of air therethrough whereby the interior surface of said charcoal filter independently serves as a second electrostatic pole having a polarity opposite said first polarity, said first electrostatic pole charging particles entering said inlet to a first polarity, said particles thereafter being electrostatically attracted to said charcoal filter during passage through said filter increasing the filtering capability of said charcoal medium.

11. An air purification filter comprising:

a housing having an inlet and an outlet for conducting a stream of air;

a charcoal filter medium in the housing located between said inlet and said outlet, capable of passing air therethrough having a first surface for receiving air to be purified in communication with said inlet and a second surface in communication with said outlet for delivering air;

means for electrically charging said charcoal filter medium to one polarity, said means including an electrical connection to the surface of said charcoal filter medium communicating with the outlet making electrical contact with said charcoal filter medium, whereby an electrostatic pole is primarily contained in the large interior surface of said charcoal filter medium; and means for charging particles in the air to be purified to an opposite polarity of said charcoal filter medium before the particles reach the first surface of said charcoal filter medium, whereby when said particles enter said charcoal filter medium they are electrostatically attracted to the oppositely charged charcoal filter medium and held thereby separated from the air.

12. An air purification filter of claim 11, wherein a fan is included in said housing so that the air is forced through said filter medium at an increased rate.

13. An air purification filter of claim 11, wherein said means for electrically charging particles has a sharp or pointed edge to facilitate optimum charging of said particles.

14. An air purification filter of claim 13, wherein said sharp or pointed edge is shaped as a needle.

15. An air purification filter of claim 13 comprising a plurality of needles arranged in a plane perpendicular to the air flow, said needles being approximately equi-distant from each other to optimize the charging of all particles in the air flow.

16. An air purification filter of claim 13, wherein said means for electrically charging particles includes at least one wire stretched in the direction of the air flow.

17. An air purification filter of claim 13, wherein said sharp or pointed edge is the edge of a blade.

18. An air purification filter of claim 13, wherein said charcoal filter medium is a cylinder and said means for electrically charging particles is within said cylinder.

19. An air purification filter comprising:

a housing forming a conduit having an inlet for receiving air containing contaminant particles to be removed therefrom, and an outlet;

an odor neutralizing substance exchangeably fixed in the housing communicating with said inlet;

a charcoal filter medium through which the air to be purified passes located between the odor neutralizing substance and the outlet, said charcoal filter medium having a surface for receiving air delivered by said inlet and a surface in communication with the outlet;

means for electrically charging said charcoal filter medium; said means including an electrical connection to the surface of said filter medium in communication with the outlet whereby said filter medium comprises an electrostatic pole of a first polarity;

means for electrostatically charging the odor neutralizing substance to the opposite polarity of said filter medium; whereby the electrostatic field produced from the charging of the filter medium and the odor neutralizing substance forces odor neutralizing particles into the air stream; and means for charging the contaminant particles in the air before said contaminant particles are received by the charcoal filter medium to a polarity opposite to the polarity of the charcoal filter medium; whereby the particles entering the filter medium are electrostatically attracted to the oppositely charged filter medium and held thereby separated from the air.

20. An air purification filter of claim 19, wherein said odor neutralizing substance is a gel.

21. An air purification filter of claim 19, wherein said odor neutralizing substance is a liquid.

22. An air purification filter of claim 19 including between said odor neutralizing substance and said inlet an electrostatic filter plate having said opposite polarity.

23. An air purification filter of claim 19, wherein said odor neutralizing substance is a scentstone.

24. An air purification filter of claim 23, wherein said scentstone contains a plurality of perforations through which said air may flow.

25. An air purification filter of claim 23, wherein an element is embedded in a scentstone for electrostatically charging the odor neutralizing substance.

* * * * *